US005720120A

United States Patent [19]

Smith

[11] Patent Number: 5,720,120

[45] Date of Patent: Feb. 24, 1998

[54] SNOW SHOE

[76] Inventor: Peter Smith, 8 Mondlay Close, Leopold VIC 3224, Australia

[21] Appl. No.: 596,270

[22] PCT Filed: Aug. 31, 1994

[86] PCT No.: PCT/AU94/00512

§ 371 Date: Feb. 7, 1996

§ 102(e) Date: Feb. 7, 1996

[87] PCT Pub. No.: WO95/06502

PCT Pub. Date: Mar. 9, 1995

[30] Foreign Application Priority Data

Sep. 1, 1993 [AU] Australia ..... PM0969

[51] Int. Cl.[6] ..... A43B 5/04

[52] U.S. Cl. ..... 36/124; 36/122; 280/600

[58] Field of Search ..... 36/122–125, 116, 36/132, 7.6; 280/600, 841

[56] References Cited

U.S. PATENT DOCUMENTS

| | | | |
|---|---|---|---|
| D. 205,186 | 7/1966 | Koskela et al. | 36/122 X |
| 397,967 | 2/1889 | Carroll | 36/7.6 |
| 1,802,116 | 4/1931 | Kinsley | 280/600 |
| 1,886,650 | 11/1932 | Davies et al. | 280/600 |
| 2,189,489 | 2/1940 | Fritz | 36/7.6 |
| 2,511,087 | 6/1950 | Villemur | 36/124 |
| 2,825,153 | 3/1958 | Fabrizio | 36/116 X |
| 2,946,599 | 7/1960 | Hunsbedt | 280/600 |
| 3,600,829 | 8/1971 | La Violette | 36/124 |
| 3,861,698 | 1/1975 | Greig | 36/122 X |
| 3,965,586 | 6/1976 | Roosli | 280/841 X |
| 4,188,046 | 2/1980 | Fleckenstein | 280/600 X |
| 4,228,601 | 10/1980 | Lawton et al. | 36/125 X |
| 4,271,609 | 6/1981 | Merrifield | 36/125 |
| 4,720,928 | 1/1988 | Faber et al. | 36/122 |
| 5,301,965 | 4/1994 | Floreani | 280/600 |
| 5,341,582 | 8/1994 | Laitaud | 36/7.6 |
| 5,459,950 | 10/1995 | Damm et al. | 36/123 X |
| 5,553,403 | 9/1996 | McManus | 280/600 X |

FOREIGN PATENT DOCUMENTS

| | | | |
|---|---|---|---|
| 542885 | 7/1957 | Canada . | |
| 634114 | 1/1962 | Canada . | |
| 2228350 | 1/1975 | France . | |
| 1759395 | 9/1992 | U.S.S.R. . | |
| 20021 | 9/1896 | United Kingdom | 280/600 |

*Primary Examiner*—Ted Kavanaugh
*Attorney, Agent, or Firm*—Seed & Berry LLP

[57] ABSTRACT

A snowshoe (1) formed from a semi-flexible platform (6) including binding means (34, 37, 39, 41, 42) for binding the heel and toe of a user's shoe or boot (50) to the platform, which is substantially imperforate, and the platform being molded from semi-flexible plastics material that can flex with the user's footwear, such as a shoe or boot.

10 Claims, 6 Drawing Sheets

SNOW SHOE

TECHNICAL FIELD

This invention relates to snow shoes.

BACKGROUND OF THE INVENTION

The present invention provides a snow shoe device which increases the user's footprint area, allowing increased support and aids in traction whilst traversing upon soft surfaces such as snow.

Many present devices are rather complex and relatively heavy assemblies requiring moving parts to function. These moving parts tend to wear and foul with ice build-up. Their weight makes them cumbersome. The older traditional tennis racket style snow shoes tend to fail after prolonged use on abrasive surfaces or particles such as ice and grit, which wear the cords that comprise the base. The size of these older type snow shoes tend to make them awkward to use. Also, known shoes are normally relatively long and rigid making them difficult to use on steep slopes.

According to the present invention there is provided a snow shoe comprising:

a platform; and binding means for binding the heel and toe of a user's shoe or boot to the platform characterised in that the platform is substantially imperforate and that at least peripheral zones of the platform can be resiliently flexed.

SUMMARY OF THE INVENTION

The problems described above are substantially overcome by the present invention. The platform can be constructed of a wear-resistant and semi-flexible plastic able to tolerate sub-zero temperatures. The heel and toe of a sole of the user's footwear is bound by the binding means so that it is unable to separate away from or move laterally or longitudinally on the platform whilst secured.

Preferably, the platform is able to flex along with the sole of the user's shoe or boot but preferably is least flexible across the ball of the foot area of the platform.

Preferably further, the platform is fastened to a person's footwear by adjustable and releasable straps, and adjustable locating blocks, without any part of the fasteners being included on the person's footwear.

Traction can be enhanced by indentations and/or cleats on the base of the platform.

Preferably further, the front and rear of the platform are curved upwards and can flex to aid the user in motion.

In one form of the invention, the upward curved front of the platform enables clearance with the surface of the snow during the motion of the user's step. The curve is directly at the front of the toe area of the platform. The platform then flattens out to a plane as it approaches the front edge of the platform. The curved upward front of the platform is flexible to enable a person's toe area on the platform to remain on or about the surface of the snow, when a downward force is acting on the toe area, and the heel is raised sufficiently so that the flat portion of the base on the curved upward front of the platform is on the surface of the snow. If the heel continues to be raised, the front of the platform is able to flex to enable the toe area to remain on or about the surface of the snow.

To assist in traction, the surface of the base of the platform may include machined or moulded shallow indentations across its entirety, except under and adjacent to cleats and at the perimeter of the base. The shallow indentations grip by allowing snow to intrude into and fill them, with a force exerted downward and perpendicular to the platform onto the top of the indentation.

The snow captured inside the indentation is then put into shear with the snow directly under it, if any force sideways is applied by the side of the indentation to the captured snow. The indentations are shallow so as not to retain the snow when the platform is lifted off the surface of the snow. To increase traction on firmer snow surfaces a load-carrying platform may flex to approach the irregular shape of the surface it is upon. This increases the surface area and amount of indentations on the platform's base which are in contact with and traction to the surface of the snow. On softer snow surfaces the platform is rigid enough to support the load of a person that the platform was intended for. The surface of the underside of the platform fittings has no indentations in regions where cleats are to be mounted. This enables better fixing and tends to reduce ice build-up adjacent to the cleats. The surface area of the periphery of the base of the platform has no indentations so as not to weaken it.

Preferably, the shallow indentations are circular grooves sunk into the base of the platform. The grooves are symmetrical to allow the platform to have traction in any direction along the surface of the snow. To aid in the flex of the platform, the indentations can be deeper across the ball of the foot area on the base of the platform.

Preferably, metal cleats are fastened to the base of the platform at the toe and heel of the foot areas to increase traction and to protect the platform on harder surfaces. Alternatively, integrally moulded cleats may be provided. The locations of the toe and heel cleats on the lower surface of the platform, along with the footwear locating blocks on the upper surface of the platform, are adjustable for both the width of the toe and length of the footwear. Each of the toe cleats is screwed or bolted at both ends through the platform to a toe block. The cleat at the ball of the foot is secured by rivets or screws to a fixed position on the platform. The heel cleat is screwed or bolted through the platform to the heel block. The cleats may be fabricated from stainless steel, sheet aluminum or made from heat treated cast aluminum or other durable material. Alternatively the cleats can be integrally moulded with the platform.

On the upper surface of the platform a moulded toe block is fastened on either side of the toe of the footwear and is set at an angle to allow the toe of the footwear to move forward and be jammed between the blocks, preventing further forward or sideways movement of the toe of the footwear. The toe block is secured at both ends. Straps are secured between the platform and toe blocks. The straps are coupled to fastening devices for binding the platform to the shoes or boots of the user. The fastening device may comprise a buckle and/or velcro patches fixed to the straps.

The toe straps, when passed over the toe of the footwear, and are tensioned, prevent the toe of the footwear from lifting off the platform and out of the toe blocks. To prevent the toe straps from sliding forward off .the front of the footwear, the location of the toe blocks on the platform can be adjusted by appropriate selection of mounting holes though the platform.

To prevent the footwear from moving backwards out of the toe blocks, a moulded plastic heel block is secured to the platform centrally behind and against the heel of the footwear. The heel block also has protrusions forward and to both sides of the heel of the footwear which stops sideways movement of the heel of the footwear. The location of the heel block on the platform is adjustable by a set of holes located longitudinally along the heel area of the platform so as to fit different length footwear. A strap with a tensioning device or velcro stitched to it is secured to the heel block by passing through a slot therein. When the strap is secured forward over the top of the foot and tensioned, it prevents the heel of the footwear from lifting off the platform and out of the heel block.

The toe and heel blocks could be integrally moulded with the platform.

The platform may be made larger or smaller depending on the weight, size and footwear size of the user. The platform may be produced in a larger size for softer snow conditions. Preferably, the platform is not so wide as to unduly interfere with the user's normal stance or stride. There may be left and fight foot platforms or they may be the same for both feet. To aid the user in descending a slope, the outside edge of the rear of the platform extends further back than the inside edge enabling a sharper point on the perimeter to be more easily dug into the snow. The inside edge of the front of the platform extends further forward than the outside edge. Similar to the big toe of that foot, this aids in the stability of the platform. Preferably, the perimeter of the platform is curved so as not to be easily snagged on obstacles.

BRIEF DESCRIPTION OF THE DRAWINGS

The invention will now be further described with reference to the accompanying drawings, in which.

DETAILED DESCRIPTION

Figure 1:
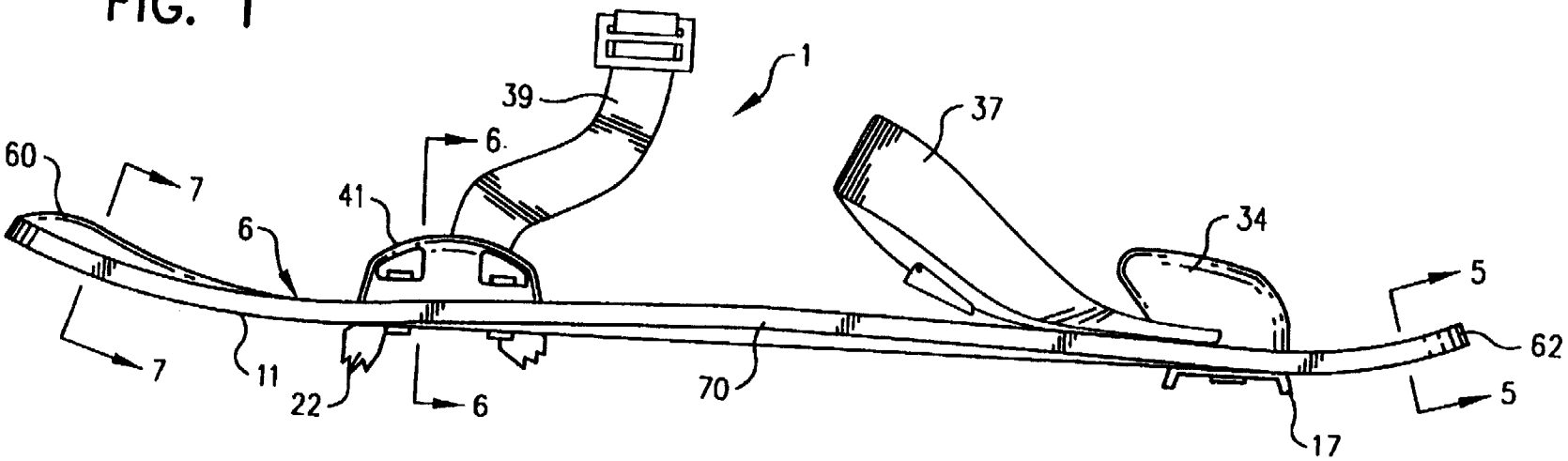
FIG. 1 is a schematic side view of a snow shoe device according to the invention.

Referring to FIG. 1 shows a schematic side view of a snow shoe device 1 according to the invention. The drawing shows the snow shoe device for a wearer's left foot. The devices of the invention would normally be made in pairs of which the fight hand shoe device (not shown) would comprise the mirror image of the device shown in the drawings.

The device 1 of the invention comprises a generally planar platform 6 which is preferably moulded from plastics material so as to have a degree of force ability as will be described hereinafter. The platform could be made by fabrication of sheet material and/or by pressing.

Figure 11:
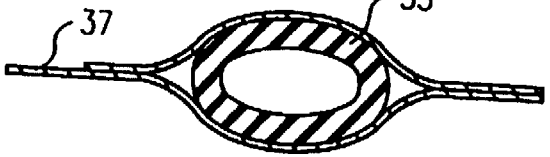
FIG. 11 is a schematic view of a shock absorbing element mounted in the heel strap.
Figure 4:
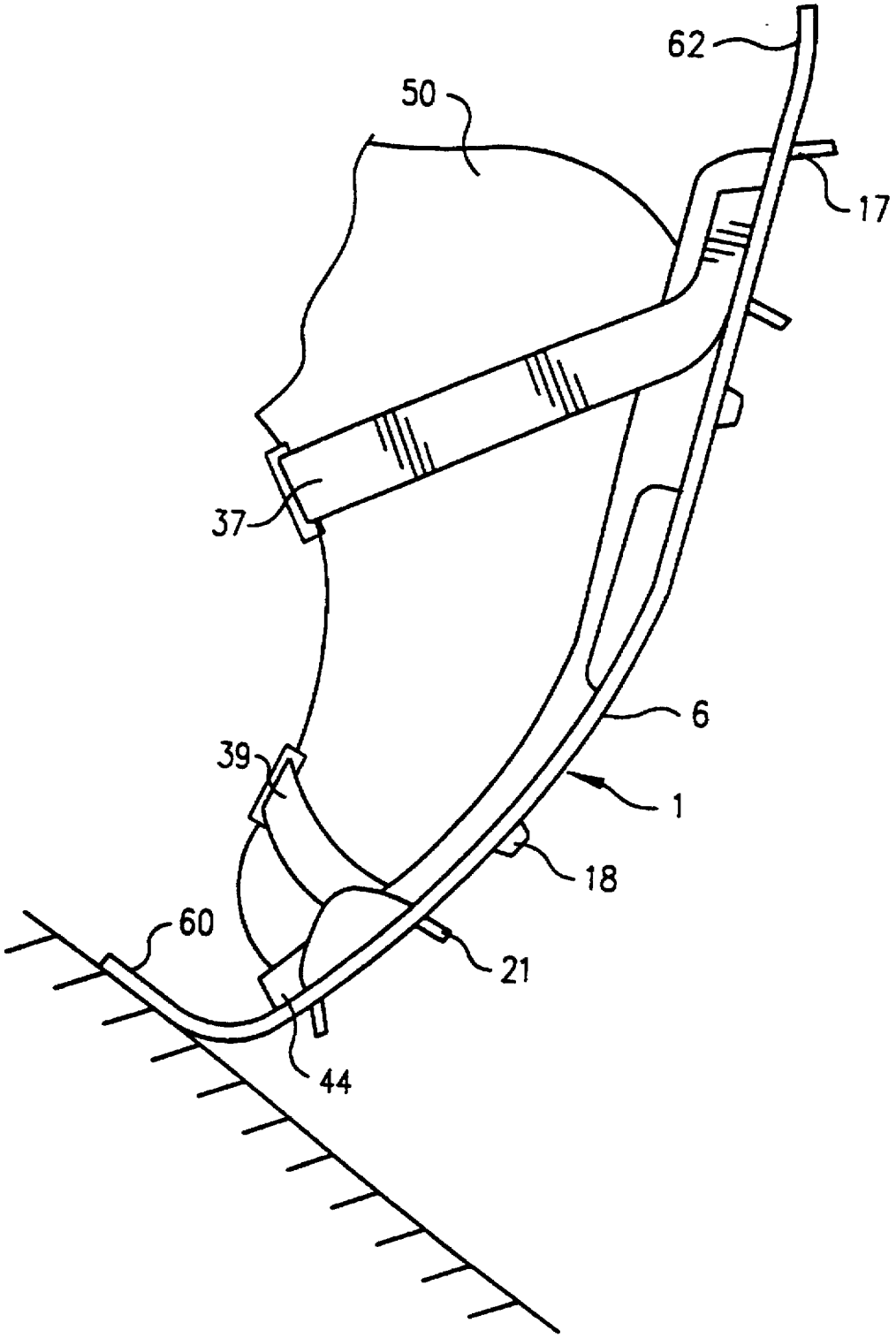
FIG. 4 is a schematic view of the snow shoe device being flexed in operation.

The device includes a heel block 34 and a pair of toe blocks 41 and 42. The device also includes a front strap 39 and rear strap 37. The straps 39 and 37 are preferably formed from webbing. The rear strap may include a hollow compressible body 35 (FIG. 11) stitched between layers of the webbing to function as a shock absorbing element. As best seen in FIG. 4, the shoe or boot 50 of the wearer is supported on the platform 6 with the heel of the shoe or boot 50 snugly engaged with the heel block 34.

The rear strap 37 passes over the shoe or boot 50 (near or above the arch) so as to securely hold the heel of the boot or shoe on the platform 6. The toe of the shoe or boot 50 is supported between the toe blocks 41 and 42 and the front strap 39 passes over the toe of the shoe or boa 50 and again securely holds the shoe or boot 50 in engagement with the upper surface of the platform 6. It is important to note that the straps 37 and 39 and toe and heel blocks operate to hold the shoe or boot 50 in contact with the platform 6 at all times when the shoe is being used. This contrasts with known forms of snow shoes where there is usually considerable movement of the heel relative to the upper surface. In known arrangements this can facilitate use of the shoes but it does have the disadvantage that snow or ice tends to build up beneath the heel and hamper their operation.

Figure 2:
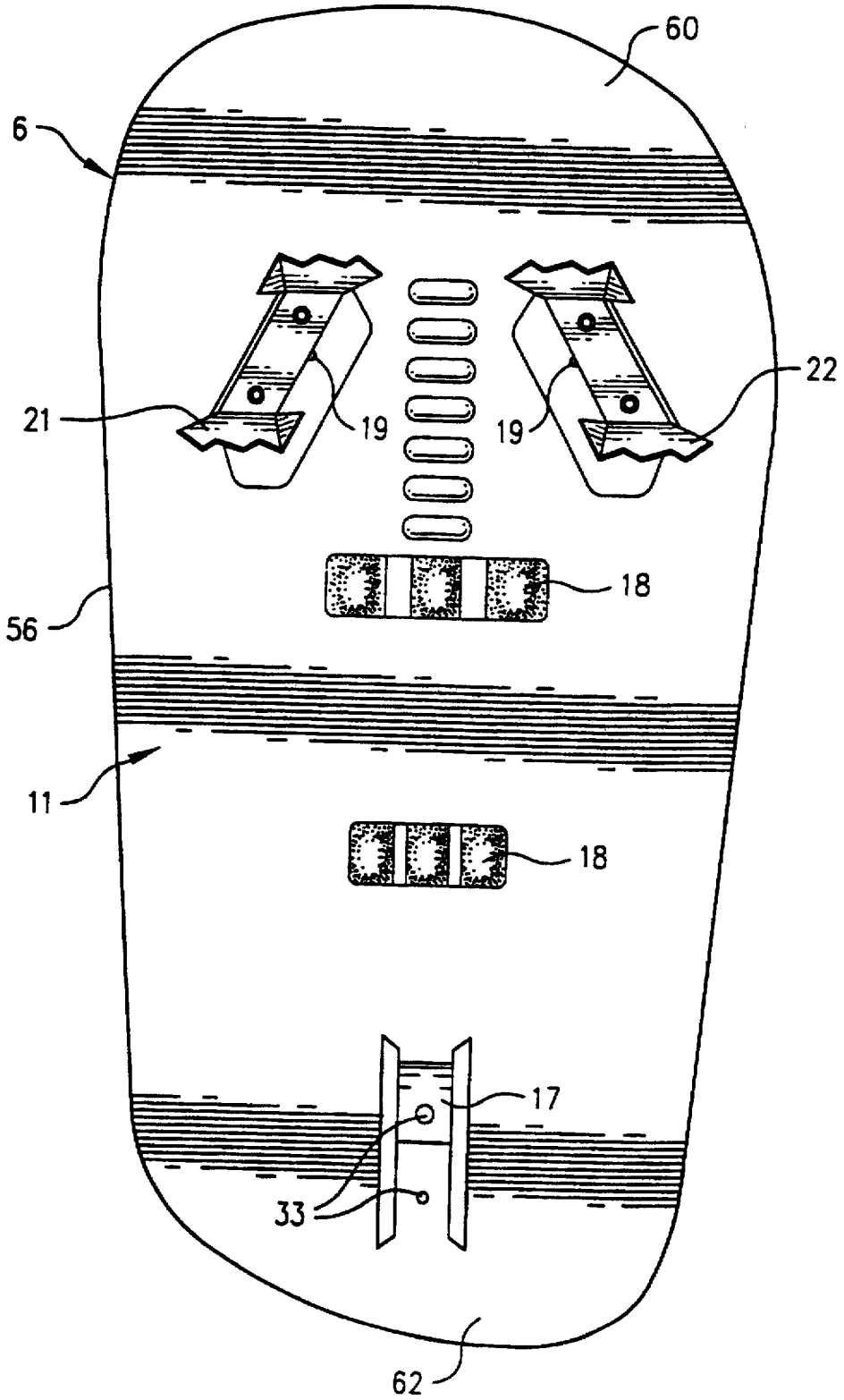
FIG. 2 is a schematic view of the lower surface of the snow shoe.
Figure 3:
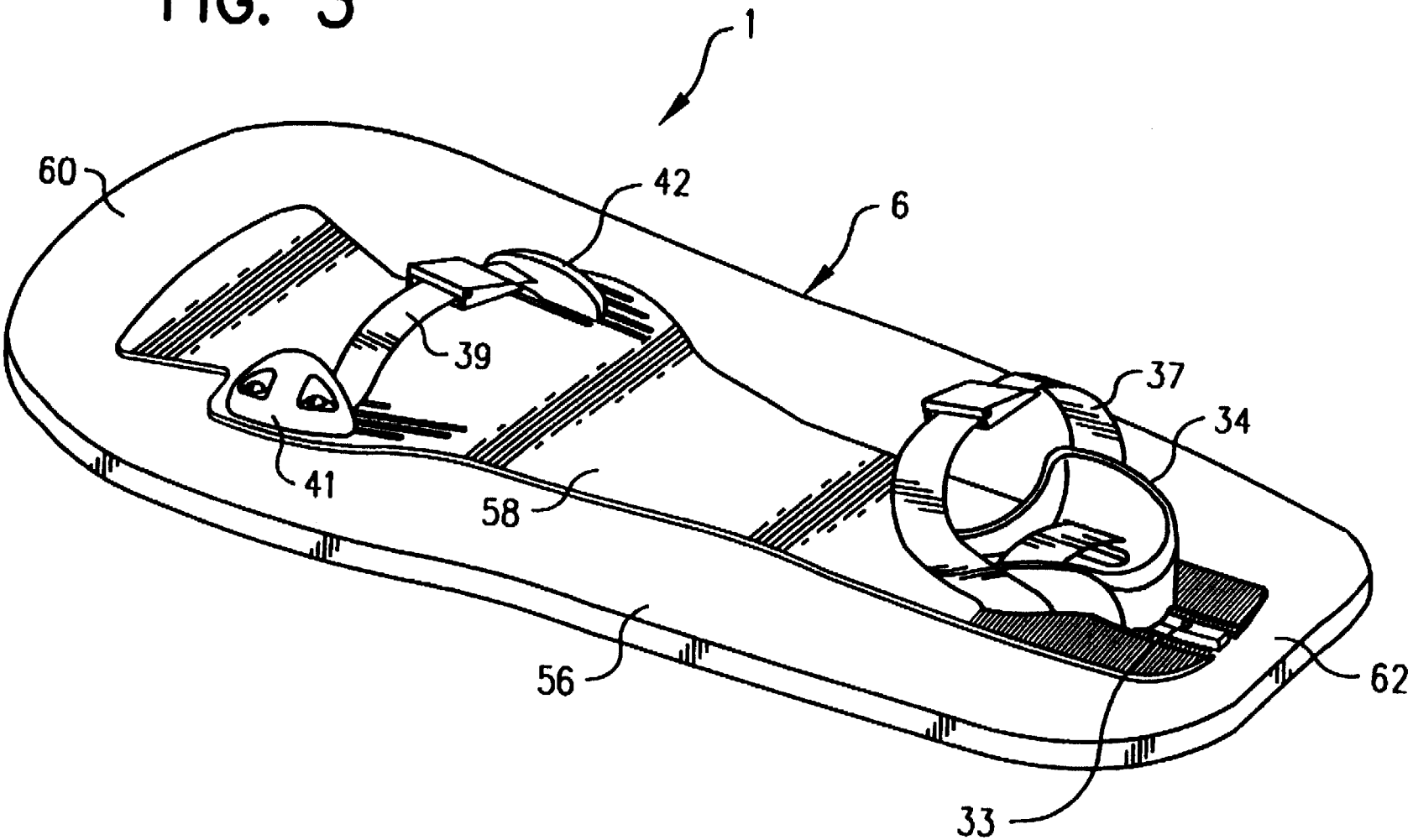
FIG. 3 is a perspective view of the upper surface of a snow shoe.
Figure 8:
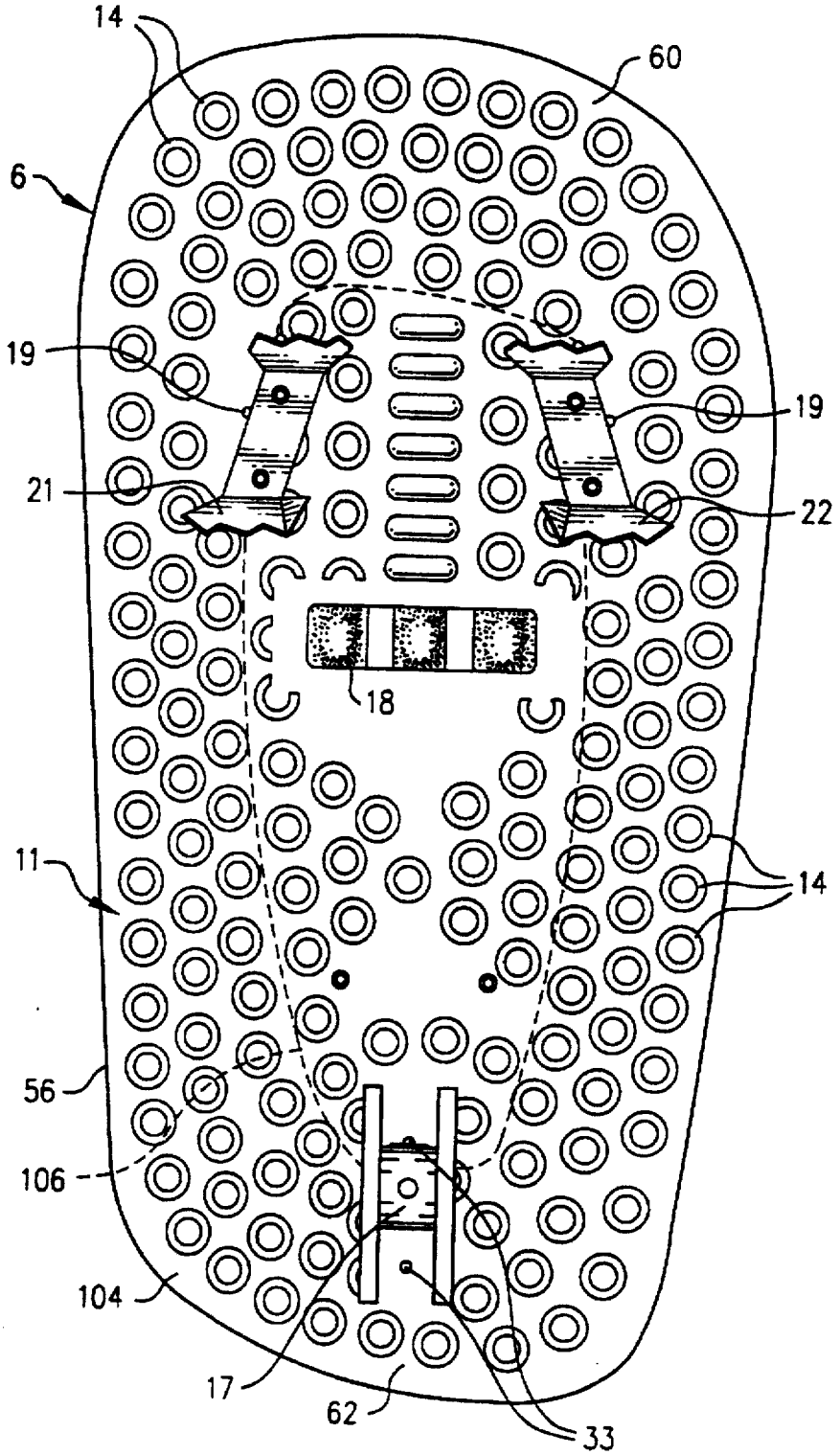
FIG. 8 is a schematic view of the lower surface of the platform showing the preferred slope of indentations.

As best seen in FIGS. 2 and 8, the underside surface 11 of the device is preferably provided with indentations or projections 14 for increasing grip of the underside surface with the snow. The device also includes dents which improve the grip of the device on snow or ice. It is preferred that the cleats are made of durable material such as metal and in particular pressed stainless steel so that they are resistant to abrasion. The location and number of dents can be varied but the preferred arrangement is shown in FIG. 2. In this drawing there is a heel cleat 17, ball dents 18 (which are integrally moulded with the platform 6) and a pair of toe cleats 21 and 22.

Figure 10:
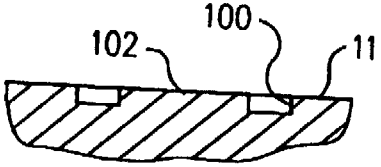
FIG. 10 is a cross-section along the line 10—10.
Figure 9:
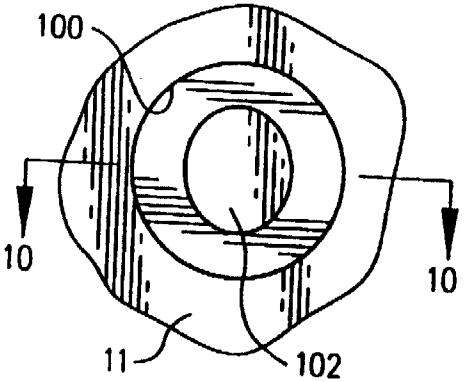
FIG. 9 is a diagram showing one of the indentations in more detail.

FIGS. 8 to 10 show the preferred shape and orientation of indentations in the underside surface of the platform. FIG. 9 is a plan view of one of the indentations. It comprises a circular recess 100 with an oval island 102 the top surface of which is at the same level as the underside surface 11, as shown in FIG. 10. For clarity of illustration, the major axes of the islands 102 are shown as straight lines in FIG. 8. The preferred orientation of the islands 102 is shown schematically in this drawing. It will be seen that in a peripheral zone 104 the orientations of the major axes of the islands 102 are generally parallel to the adjacent part of the rim 56, a broken line 106 generally deliminating the inner periphery of the zone 104. Within the line 106, the major axes of the islands 102 are transverse to the longitudinal direction of the shoe, as seen in FIG. 8. It has been found that this orientation optimises the performance of the shoes from the point of view of minimising slipping. It is further preferred that the diameter of the recess 100 is in the range 15 to 25 mm and preferably 19 mm. It is further preferred that the depth of the recess 100 is in the range from 1 to 1.5 mm and preferably 1.2 mm. It is further preferred that the sidewalls of the recess 100 and the island 102 tapor inwardly at an angle of say 3° and merge into the base of the island 102 at a radius of about 0.5 mm.

It is further preferred that the heel cleat 17 and toe cleats 21 and 22 are respectively located beneath the heel block 34 and toe blocks 41 and 42. In this way the mounting screws 51 can be used to interconnect the blocks and cleats. In the illustrated arrangement the platform 6 includes a number of forward screw holes 19 and rearward holes 33 through which the screws pass. A range of hole locations may be provided so as to permit adjustment of the location of the blocks and cleats according to the size of the shoe or boot 50 of the wearer. The screw holes for the screws 51 can be made elongate to provide further adjustment of the positions of the toe and heel blocks on the platform.

The heel and toe blocks are chosen so that when the shoes are used there is little or no movement applied to the foot of the user. Accordingly it is preferred that the centroid of the projected area of the foot of the user is aligned with the centroid of the area of the platform 11.

Figure 6:
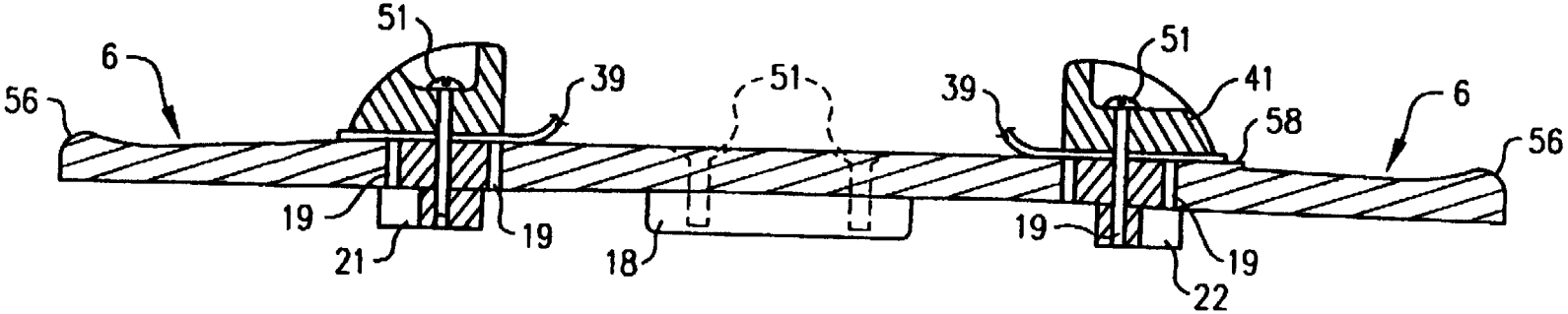
FIG. 6 is a cross-sectional view along the line 6—6.

As best seen in FIG. 6, the ends of the front strap 39 can be damped between the platform 6 and the toe blocks 41 and 42. On the other hand the heel block 34 may be provided with slots 5 (see FIG. 1) through which the rear strap 37 passes.

The structure of the platform 6 is important to the performance of the snow shoes of the invention. The platform 6 is designed so that it has a degree of flexibility which enables it to flex with the normal flextite of the shoe or boot 50 of the user, as illustrated diagrammatically in FIG. 4. It is also preferred that there be a greater degree of flexibility in the regions from the shoe or boot 50 towards the periphery of the platform. The platform is preferably provided with a peripheral rim or bead 56 which provides strength at the periphery and therefore resists excessive flexure or breakages at the periphery.

Figure 5:
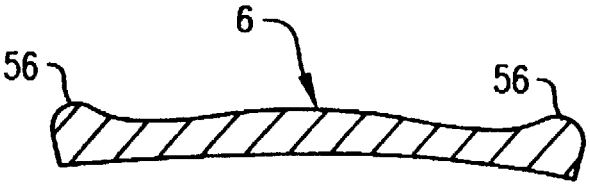
FIG. 5 is a cross-sectional view along the line 5—5.
Figure 7:
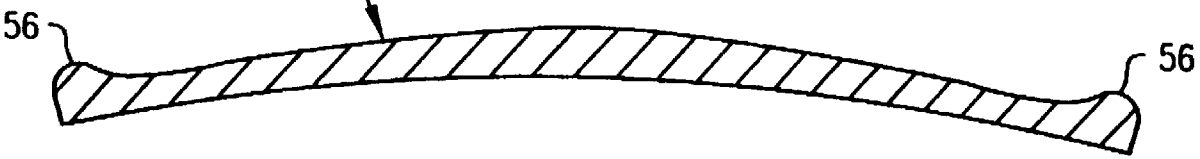
FIG. 7 is a cross-sectional view along the line 7—7.

The platform is preferably moulded from plastics material such as polyurethane. However, other semi-flexible plastics materials may also be used such as polyvinyl chloride, polypropylene, polyethylene, nylon, ABS, polycarbonate, polyesters, copolymers and other engineering thermoplastics. It is preferred that the thickness of the platform at a central portion 58 has a thickness in the range from 5 mm to 8 mm and preferably 7 mm. The central portion 58 generally corresponds to the area which will be contacted by the shoe or boot 50 of the wearer. The platform then tapers somewhat towards the periphery and then thickens out to form the rim 56, as best ,seen in FIGS. 5, 6 and 7. It is preferred that the minimum thickness of the platform is in the range 1.5 mm to 4 mm and preferably 2 mm. The thickness of the bead or rim 56 is preferably the same as the thickness of the central portion 58.

The platform 6 is also moulded so as to have an upwardly curved forward portion 60 and an upwardly curved rear portion 62. These upwardly turned portions help to prevent the edges of the snow shoe being caught in the snow or on obstructions. The curved portions also assist to some extent in flexure of the end portions about transverse axes. This flexure makes the devices easier to use, particularly on steep terrain, as seen in FIG. 4.

It is also preferred that the platform 6 has a concave portion 70 (as seen in side view in FIG. 1). This gives rigidity in the longitudinal direction. The platform 6 may be slightly concave across a central transverse cross-section but this is not shown in FIG. 6.

It is further preferred that the platform has concave profiles in the forward and rear portions 60 and 62 of the platform but these concave profiles are in planes transverse to the concave portion 70. This makes the front and rear portions more resistant to flexure about longitudinal axes because the concavity imparts a degree of stiffness to the end portions.

It is further preferred that the upper surface of the platform 6 be smooth and imperforate (except for the small screw holes 19 and 33) so that snow and ice can fall from the top surface without accumulating thereon.

It is preferred that the overall length of the platform 6 of an adult size shoe is in the range from 450 mm to 600 mm and preferably 490 mm. It is further preferred that the width of the platform 6 is in the range 200 mm to 400 mm and preferably 260 mm near the toe region. It is further preferred that the heel region be narrower by about 30% than the toe region and that the preferred width near the heel block 34 is 180 mm. It is further preferred that there be more overhang at the toe of the platform than at the heel. The toe overhang is the distance between the centres of the toe blocks 41 and 42 and the front edge of the platform, the rear overhang is the distance between the centre of the heel block 34 and the rear edge of the platform. The toe overhang is in the range from 15% to 25% of the overall length and preferably 20%. It is preferred that the heel overhang be about 50% of the toe overhang.

It is also desirable that the shoes of the invention be relatively light so that they are relatively easy to use and not tiring for the wearer. Prototypes have been made and tested and the weights were in the range 500–2000 gm per pair.

The hardness of the platform is in the range from 50 to 90 shore D and preferably 55° to 70° at about 18° C. The hardness will increase with decreasing temperature and thus the degree of flexibility will decrease with temperature. Where the platform is to be produced by injection moulding it may comprise a RE-FLEX thermoplastic polyurethane supplied by Townsend Chemicals Pty. Ltd., Victoria, Australia such as grades 223, 157 and 262 which have shore hardnesses of 95A, 65D and 75D respectively, and tensile strengths at break of 366, 438 and 447 kg/cm$^2$ respectively.

A prototype has been tested for flexibility and the results are as follows. The underside surface 11 of the platform was supported near the toe and heel ends and a weight was applied at a point generally corresponding to the point where the user's weight would be concentrated at the ball of the foot, that is to say the weight was applied at a point approximately 64 mm from a line joining the toe blocks 41 and 42. With a weight of 13.5 kg the downward deflection was approximately 80 mm at −15° C. and 150 mm at +13° C.

A further prototype having a length of about 480 mm and maximum width of 255 mm was subjected to bending tests and the following results were obtained:

(i) at 5° C. a vertical load of 4 kg was required to produce a lateral deflection of 100 mm (measured at a point about 270 mm from the heel end of the platform);

(ii) at −20° C. a vertical load of 8 kg was required to produce the same deflection as in (i).

Many modifications will be apparent to those skilled in the art without departing from the spirit and scope of the invention.

I claim:

1. A flexible snow shoe comprising:

(a) a platform formed from a unitary piece of imperforate, resilient material having a bead formed at least partially around an outside edge, said platform being sized and shaped to extend beyond a user's footwear in all direction to thereby support the user on a snow-covered surface, said platform being molded from semi-flexible plastic material whereby said platform can flex in a zone located in use beneath a ball part of the user's footwear, said platform having an underside formed with indentations and projections for increased traction on snow, said indentations including recesses and said projections comprising an oval-shaped island within said recesses, a top surface of said oval islands being at the same level as adjacent parts of said underside of said platform;

means for binding the user's footwear to said platform, said binding means comprising a toe block and a heel block projecting from said platform for engaging with toe and heel parts of the user's footwear, and a front strap and a rear strap that can be releasably fasten about toe and heel parts of the user's footwear.

2. The snow shoe of claim 1, wherein said oval islands include major axes that are selectively oriented on said underside of said platform.

3. The snow shoe of claim 1, wherein said platform has an upwardly curved forward portion and an upwardly curved rear portion.

4. The snow shoe of claim 3, wherein said platform has a concave central portion.

5. The snow shoe of claim 4, wherein the length of said platform is in the range of 450 mm to 600 mm, and the width of said platform is in the range of 200 mm to 400 mm.

6. The snow shoe of claim 5, wherein a rear portion of said platform is about 30% narrower than a forward portion of said platform.

7. The snow shoe of claim 6, wherein the minimum thickness of said platform is in the range of 1.5 mm to 4 mm.

8. The snow shoe of claim 7, wherein said platform tapers in thickness from said central portion towards said outside edge.

9. The snow shoe of claim 8, wherein said platform is molded from polyurethane, polyvinyl chloride, polypropylene, polyethylene, nylon, ABS, polycarbonate or polyesters.

10. The snow shoe of claim 9, wherein the hardness of said platform is in the range of to 90 shore D at about 18° C.

* * * * *